US005364028A

United States Patent [19]

Wozniak

[11] Patent Number: 5,364,028

[45] Date of Patent: Nov. 15, 1994

[54] PNEUMATIC TIMED SPRAY DISPENSER

[76] Inventor: Walter E. Wozniak, 18606 Oakwood Dr., Prairieville, La. 70769

[21] Appl. No.: 205,862

[22] Filed: Mar. 3, 1994

[51] Int. Cl.[5] ..... B65D 83/26

[52] U.S. Cl. ..... 239/70; 137/624.14; 222/649

[58] Field of Search ..... 239/67, 70, 99; 222/649, 645; 137/624.14

[56] References Cited

U.S. PATENT DOCUMENTS 3,848,775 11/1974 Possell ..... 222/649
4,114,515 9/1978 Pauliukonis ..... 137/624.14
4,544,086 10/1985 Hill et al. ..... 222/649
5,025,962 6/1991 Renfro ..... 222/649
5,249,718 10/1993 Muderlak ..... 239/70

*Primary Examiner*—Andres Kashnikow
*Assistant Examiner*—Christopher G. Trainor
*Attorney, Agent, or Firm*—William David Kiesel; Robert C. Tucker; Warner J. Delaune, Jr.

[57] ABSTRACT

A pneumatic timed spray dispenser for automatically dispensing a quantity of the contents of a pressurized reservoir to the atmosphere at predetermined intervals, containing a timing piston structure utilizing the pressure in the reservoir to permit discharge of the contents to the atmosphere in an atomized form.

5 Claims, 6 Drawing Sheets

PNEUMATIC TIMED SPRAY DISPENSER

BACKGROUND OF THE INVENTION

1. Field of the Invention

The present invention relates generally to automatic spray dispensers for releasing pressurized contents from an attached pressurized reservoir, and more particularly to pneumatic timed spray dispensers which use as their sole energy source the pressure contained in the pressurized reservoir.

2. Prior Art

The most effective method of using some products, such as insecticides and air fresheners, is to spray quantities of the product into the atmosphere at regular intervals. In practice these regular intervals are difficult to achieve with the manual valves generally supplied with the reservoir. They a difficult time maintaining a regular schedule of spraying. A better way to ensure regular dispersals of the product is to attach a spray dispenser to the reservoir which will automatically periodically release the product. Once the automatic spray dispenser is attached to the reservoir, the reservoir may then be placed in an advantageous location, such as near the ceiling or in an attic or basement. Once properly positioned, it can be allowed to operate unattended. This ensures the product will get where it is needed, when it is needed.

An automatic spray dispenser that is simple in construction effective in dispersing at regular intervals a fixed quantity of product, and easy to manufacture would be highly desirable. Unfortunately, dispensers that use electronic timers and valves are expensive and require an electrical current source. Heretofore, dispensers which use reservoir pressure as their sole energy source have had problems. More particularly, many such dispensers were complex in design and difficult to manufacture. Another problem experienced with certain automatic timed spray dispensers which utilize the container pressure as the sole motive force is their inability to discharge substantially all of their contents. Still another problem of prior art spray dispensers has been their inability to maintain a substantially constant time interval between discharge. These problems resulted from the manner in which the container pressure was utilized to dispense the pressurized contents. One solution to this problem is disclosed in U.S. Pat. No. 5,025,962 assigned to one of the co-inventors herein. The dispenser disclosed in that patent utilized a timing piston contraction that maintained a constant pressure differential on opposing sides of the timing piston. Although this design solved certain prior art problems the resultant discharged contents were not sufficiently atomized due to separation of the propellant and the active fluid in the pressurized container. When not properly atomized, the active ingredients form droplets which immediately fall wasted to the floor, rather than forming the fine mist required for the product to be carried by the air and properly dispensed.

SUMMARY OF THE INVENTION

It is an object of the present invention to provide an automatic spray dispenser that operates solely on the pressure contained in the pressurized reservoir but that is effective, simple in design, easy to manufacture and inexpensive.

Another object of the present invention is to provide an automatic spray dispenser having a direct exhaust pathway from the pressurized reservoir to the atmosphere.

A further object of the present invention is to provide an automatic spray dispenser which uses the pressure differential between two chambers to actuate the timing mechanism.

A still further object of this invention is to provide an automatic timed spray dispenser that discharges the contents of a pressurized container in an atomized form using only the container pressure as the motive force.

Another preferred embodiment of this invention is to provide an automatic timing spray dispenser which utilizes as its motive force the container pressure to discharge substantially all of the container contents.

These and other objects and advantages of the present invention will become apparent from the descriptions herein.

Accordingly, a spray dispenser operably attachable to a discharge nozzle of a pressurized container containing liquid or gaseous material for the purpose of making timed discharges of discrete quantities of the material into the atmosphere which comprises an elongated body having a passageway with a central axis extending through and connecting opposite first and second ends of the elongated body; the first end of the elongated body shaped to receive the discharge nozzle of the pressurized container; a timing piston positioned in the passageway and shaped to slide within a portion of the passageway wherein a first end of the timing piston, along with the first end of the elongated body, forming a lower passageway section within the passageway to receive the contents from the pressurized container; a valve piston having first and second ends positioned in the passageway, the first end of the valve piston, along with the second end of the timing piston, forming a timing passageway section within the passageway, and the second end of the valve piston, along with the second end of the elongated body, forming a valve piston passageway section within the passageway, and wherein the second end of the elongated body is provided with a valve passageway connecting the valve piston passageway to the atmosphere; and an exhaust tube operatively connected at one end to the elongated body to receive the liquid or gaseous material in the lower passageway section when the lower passageway section is at approximately its minimum volume and operatively connected at an opposite end to the valve passageway, and wherein the lower passageway section and the timing passageway section are only connected to one another by a timing passageway to maintain a substantially constant pressure drop between the timing passageway section and the lower passageway section during operation of the spray dispenser; wherein the cross-sectional area of the passageway increases from the lower passageway section to the timing passageway section, and then to the valve piston passageway section; and wherein the cross-sectional areas of the passageway sections and the cross-sectional area of the valve passageway are sized to cause the timing piston to move along the central axis of the passageway in a manner to periodically operatively connect the lower passageway section to the exhaust tube permitting the contents to enter the exhaust tube.

PREFERRED EMBODIMENTS OF THE INVENTION

In one broad embodiment of the invention the spray dispenser utilizes a two-sided timing piston fitted within a passageway of an elongated body so as to form separate chambers at the opposite ends of the timing piston. Each of the opposite timing piston ends will have different surface areas. In this broad embodiment the chambers on each end of the piston are connected by a fluid metering device that can be formed as part of the piston. In this manner the pressure drop across the fluid metering device remains nearly constant during the dispensing operation. Any dispenser construction that maintains a nearly constant pressure drop across the fluid metering device during the dispensing operation and which also permits a substantial portion of the pressurized contents to be discharged directly into the atmosphere in an atomized form would be within the broadest scope of this invention.

Figure 1:
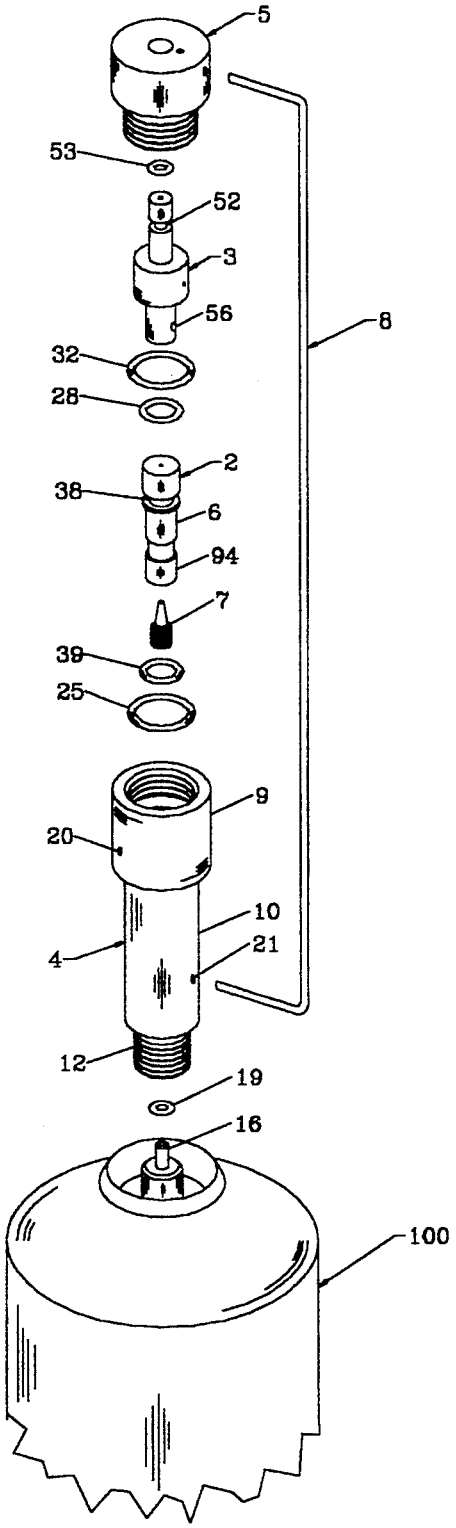
FIG. 1 is an exploded view of a preferred embodiment of the spray dispenser of the present invention.
Figure 2:
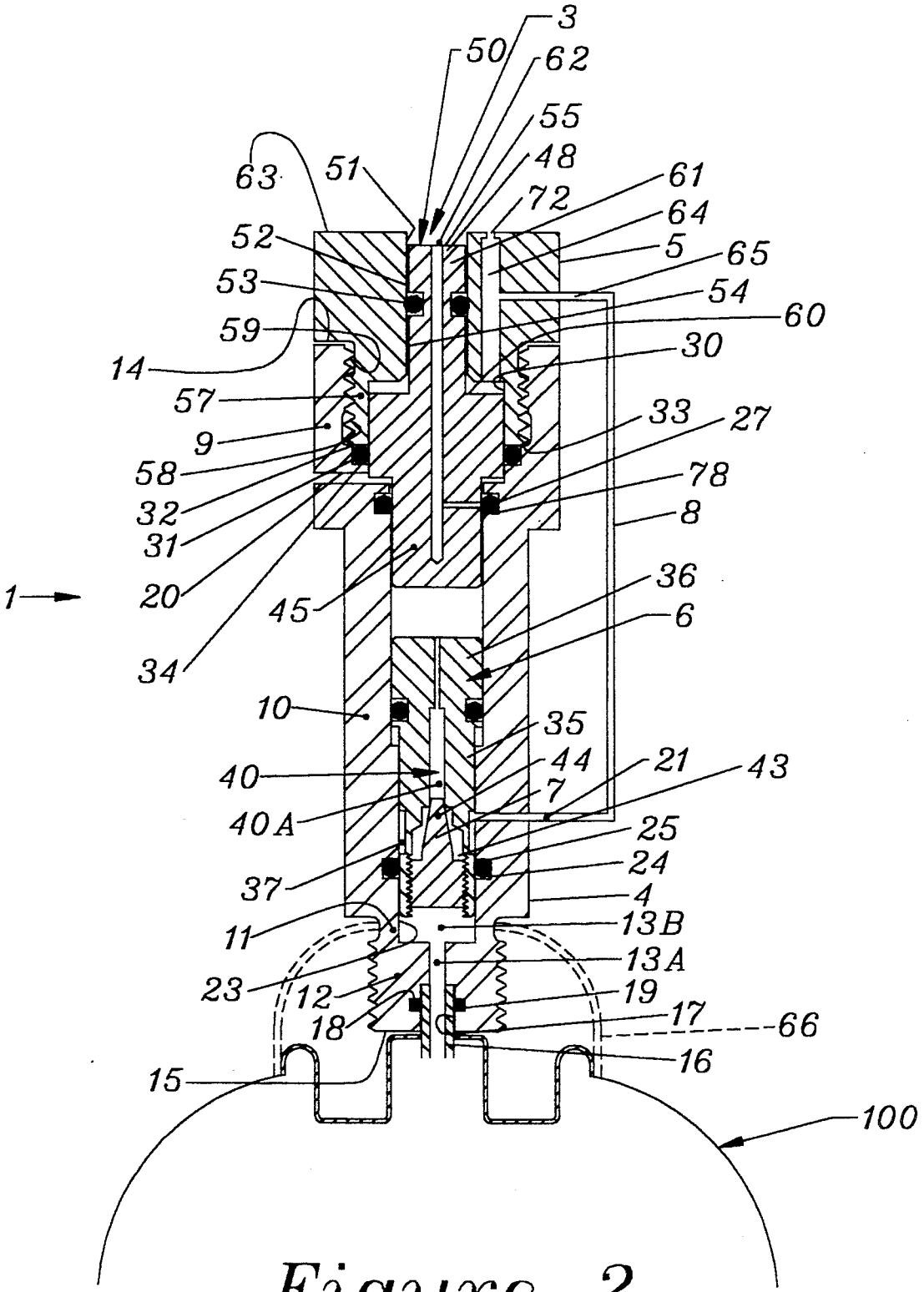
FIG. 2 is a cross-sectional view of the spray dispenser of FIG. 1 with the parts in actual relationship with one another.

In the preferred embodiment of the invention illustrated in FIGS. 1 and 2 the pneumatically timed spray dispenser comprises three basic parts which are combined with one another to provide a direct exhaust pathway from the pressurized container 100 to the atmosphere in a manner to allow a timed release of an increment atomized portion of the properly mixed gaseous propellant and liquid active ingredients in pressurized container 100. Not including the various O-ring seals, the three basic parts include a body 1, a timing piston 2, and a valve piston 3.

To aid in the manufacture and assembly of the dispensing apparatus body 1 may be constructed in two parts: lower part 4 and upper part 5. These two parts are connected to one another by mating threads as described herein below. They could also be connected by other conventional means, such as snaps or by gluing. Similarly, timing piston 2 may be constructed of piston body 6 and a metering device, such as needle valve 7, that can be screwed, or otherwise affixed, to piston body 6. This latter embodiment allows one to regulate the timing by simply changing needle valve 7 for another needle valve having a different diameter passageway. In an alternate embodiment the timing can be regulated by constructing needle valve 7 from a porous metal block. Even in this more preferred embodiment, not including the O-rings, the dispensing apparatus comprises only five separate parts which each are simple to manufacture. Also from a construction standpoint, the most preferred embodiment also comprises a separate hollow exhaust tube 8 operatively connected to the lower body part 4 and the upper body part 5 to permit direct passage of the pressurized contents from the pressurized container 100 to the atmosphere. Alternatively, this connecting passageway could be achieved by properly sealed connecting passageways in the exterior walls forming the lower body part 4 and the upper body part 5.

Lower part 4 is preferably constructed to form a one piece generally cylindrical-shaped body having an upper connecting section 9, a middle section 10, neck section 11, and externally threaded fluid receiving section 12. Lower part 4 also has a fluid passageway 13 that extends along its center vertical axis from upper connection section top surface 14 to fluid receiving section bottom surface 15.

Fluid passageway 13 is preferably constructed to have four connected sections with varying cross-sectional areas: fluid entry passageway section 13A, lower passageway section 13B, timing passageway section 13C, and valve piston passageway section 13D.

Fluid entry passageway section 13A is constructed to receive pressurized container discharge nozzle 16 in a manner that allows fluid to pass from nozzle 16 into fluid entry passageway section 13A and then into lower chamber passageway section 13B. In a preferred embodiment side wall 17 which forms fluid entry passageway section 13A is provided with an O-ring groove 18 that extends circumferentially about side wall 17. O-ring 19 is positioned in groove 18 which is positioned in side wall 17 to permit discharge nozzle 16 to sealingly extend through O-ring 19 and further into fluid entry passageway section 13A. O-ring 19 also assists in positioning lower body part 4 on pressurized container 100.

In one preferred embodiment lower body part 4 may also be provided with any conventional means, such as a shroud, that would allow it to be affixed in operative position to the pressurized container to permit the pressurized contents to enter fluid entry passageway section 13A. In an alternate embodiment the dispensing apparatus could form part of the pressurized container 100. In this alternate embodiment the construction would also be such to replace fluid entry passageway section 13A.

Lower body part 4 is also provided with a vent 20 that connects the lower area of valve piston passageway section 13D with the atmosphere so as to permit movement of the valve piston 3 within passageway section 13D. Lower body part 4 will also be provided with an exhaust port 21 that connects lower passageway section 13B with exhaust tube 8.

Side wall 23, along with bottom wall 90 and the bottom of needle valve 7, form lower passageway section 13B and is also similarly provided with interior annular O-ring groove 24 into which O-ring 25 is placed. O-ring groove 24 will be properly positioned between exhaust port 21 and fluid entry passageway section 13A to form a sealed area of lower chamber passageway section 13B during the timing and resetting stages of operation. The positioning of O-ring groove 24 is also set to permit gases and fluids in lower passageway section 13B to flow through groove 37 and then into exhaust tube 8 during the dispensing and exhaust stages of operation.

Body wall section 26, along with end wall 46 and upper surface 91 of timing piston 2, form timing passageway section 13C is also similarly provided with interior annular O-ring groove 27 into which O-ring 28 is placed. O-ring grove 27 is positioned to provide an upper seal of timing passageway section 130 during the timing and dispensing stages of operation, but to permit gases and fluids in timing passageway section 130 to escape to the atmosphere during the exhaust and resetting stages of operation. In the preferred embodiment this positions O-ring groove 27 operatively connecting with timing passageway section exhaust port 29 during the exhaust and resetting stages, but not during the timing and dispensing stages of operation.

Body wall section 30, along with upper shoulder surface 92 and lower shoulder wall 93 of upper body part 5, form valve piston passageway section 13D is also similarly provided with interior annular O-ring groove 31 into which O-ring 32 is placed. O-ring groove 31 is positioned to seal the lower portion of valve piston passageway section 13D from the upper portion of passageway section 13D. In the preferred embodiment illustrated in the figures, this positions O-ring groove 31 above vent 20 and between lower end 33 of upper body 5 and shoulder wall 34 of body wall section 30.

Timing piston 2 is shaped to be positioned within lower passageway section 13B and timing chamber passageway section and to move up and down the central axis of those two passageway sections a predetermined distance. More particularly, timing piston 2 comprises a first section 35 which will slide into both passageway sections 13B and 130, and a second section 36 which slides only into timing passageway section 13C. First section is provided with an exterior annular groove 37 that is positioned to face opposite O-ring groove 24 during the dispensing and timing stages of operation so as to break the upper seal of the lower chamber passageway section 13B. Timing piston second section 36 is also provided with an exterior annular groove 38 into which is placed O-ring 39 to provide a seal between the inner wall surface of timing passageway section 130 and the exterior wall surface of second section 36. This seal is maintained between lower passageway section 13B and timing passageway section 13C during all stages of operation.

Timing piston 2 is further provided with a timing passageway 40 that extends along the central axis of timing piston 2 to connect lower passageway section 13B to timing passageway section 13C. In the preferred embodiment illustrated needle valve 7 will be threaded in a conventional manner to allow fluid to flow between needle valve threads 41 and timing threads 42 and then into timing passageway 40. The diameter of timing passageway 40 can vary in order to regulate the amount of fluid flow, and hence the timing between successive dispensing stages of operation.

Needle valve 7 is sized so that the tip 44 of needle valve 7 protrudes into timing passageway section 40A.

Valve piston 3 comprises three sections. First section 45 is provided with a diameter that will slide into passageway section 13C. The end wall 46 of first section 45 forms one end of timing passageway section 130. Second section 47 is provided with a larger diameter than first section 45, and is sized to press against O-ring 32 when second section 47 is inserted into passageway section 13D. Third section 48 is sized to extend through upper body central axial cavity 50 formed by interior wall surface 51, and is provided with an exterior annular groove 52 into which O-ring 53 is placed to effect a seal between the wall surface 51 of cavity 50 and exterior wall surface 54 of third section 48.

Timing chamber exhaust port 29 extends from end surface 55 of third section 48 along the center axis of valve piston 3 a distance which will align transverse port extension 56 with O-ring 28 during the exhaust and resetting stages of operation.

Upper section 5 of body 1 comprises a first section 57 having exterior threads 58 that matingly screw into threaded wall 59 of valve piston passageway section 13D. First section 57 is also provided with an antechamber 60 that forms part of passageway 50 into which valve piston second section 47 slides along the central axis of the antechamber 60 during operation. Upper section 5 also comprises a second section 61 which has an antechamber 62 which also forms part of passageway 50 and that connects and is aligned with antechamber 60, and into which valve piston third section 48 slides along the central axis of the antechamber 62 during operation.

Extending from upper body end surface 63 and into valve piston passageway section 13D is valve passageway 64. One end of exhaust tube 8 is operatively connected by transverse valve passageway extension 65 to valve passageway 64 to permit the gases and fluids from exhaust tube 8 to vent to the atmosphere and to valve piston passageway section 13D. This connection can be made by any known conventional manner such as a pressed fit, mating, threaded ends, etc.

OPERATION

Figure 3:
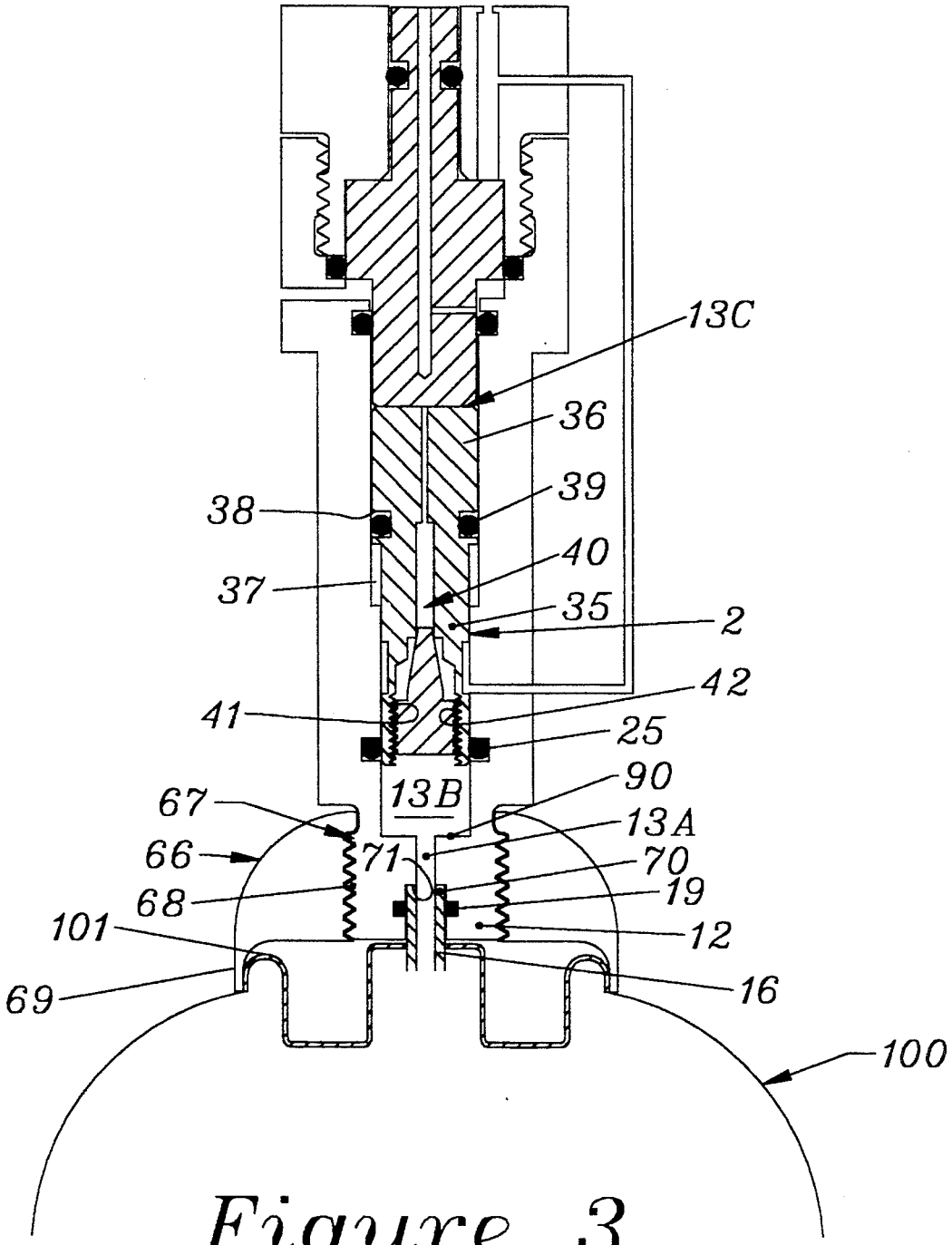
FIG. 3 is a cross-sectional view of the spray dispenser of the present invention in the timing increments stage of its cycle.

The operation of the dispensing apparatus is better understood by reference to FIGS. 3–6. Beginning with the timing state of the operation as best represented in FIG. 3, the dispensing apparatus is attached to pressurized container 100 by inserting discharge nozzle 16 through O-ring 19 in passageway section 13A. In a typical pressurized container the discharge of the contents in the container is activated by pressing down on the discharge nozzle. In these types of containers it will be necessary to provide a latching means to not only hold the dispensing apparatus to the container, but also to do so in a manner which presses down on the discharge nozzle. There are many conventional means which can accomplish these two functions. One example would include a shroud 66 that has a threaded opening 67 which could be screwed onto the exterior surface threads 68 in body fluid receiving section The shroud would also have a flexible envelope 69 that can be snapped onto the rim 101 of container 100 in a conventional manner. In this embodiment as threads 68 are screwed into threaded opening 67 the tip 71 of discharge nozzle 16 will strike shoulder wall in fluid entry passageway section 13A. As threads 68 are continued to be screwed into threaded opening 67, nozzle tip 71 will be depressed causing the contents in container 100 to discharge into fluid entry passageway section 13A.

The contents will flow from fluid entry passageway 13A into lower passageway section 13B. When the pressure builds to a predetermined level, the contents will leak between needle valve threads 41 and timing threads 42, and then through timing passageway 41 into timing passageway section 13C. Because the diameter of the second section 36 of timing piston 2 is greater than the diameter of the first section 35 of timing piston greater force will be applied to the top of timing piston 2 than to its bottom. Once the force differential is sufficient to overcome the frictional forces of O-rings 25 and 38 and any frictional forces caused by contact between the interior walls forming passageway sections 13B, 13C and the exterior walls of timing piston 2, timing piston 2 will begin to travel toward passageway section 13A. This time period is referred herein as the timing stage of the operation.

Figure 4:
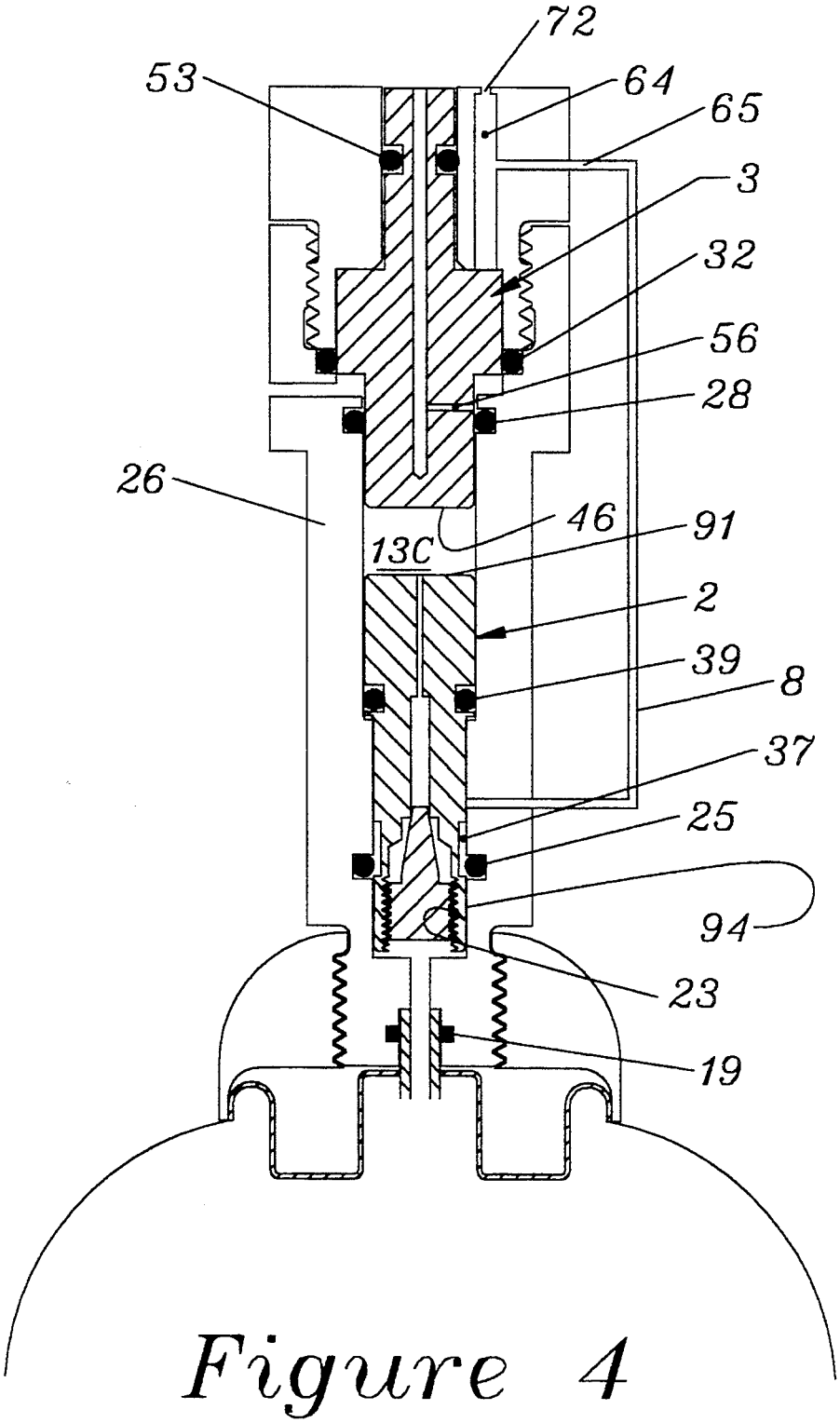
FIG. 4 is a cross-sectional view of the spray dispenser of the present invention in the dispensing stage of its cycle.

The dispensing stage of the operation is better understood by reference to FIG. 4. When timing piston 2 has traveled as far as is permitted, annular groove 37 will be aligned with O-ring groove When this occurs the seal between exhaust passageway 8 and lower passageway section 13B is broken. The contents of container 100 can now leak between timing piston side wall 94 and lower body wall 23. This permits the contents to then flow into exhaust tube 8. The contents then flow into valve passageway 64 via transverse passageway extension 65. Valve passageway 64 is provided with an exhaust orifice 72 that permits the contents to be discharged into the atmosphere. This is referred to herein as the dispensing stage of the operation.

Figure 5:
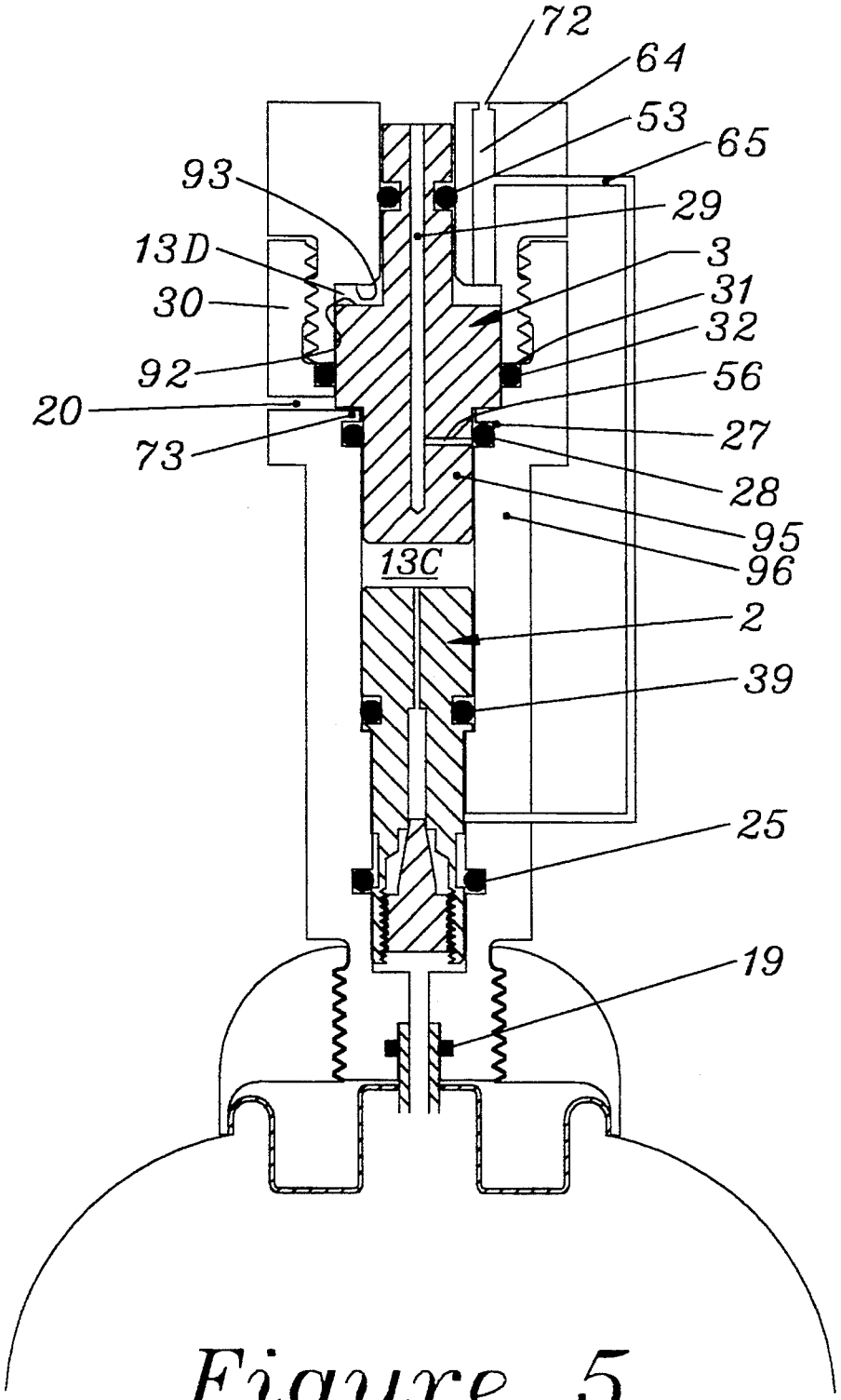
FIG. 5 is a cross-sectional view of the spray dispenser of the invention in the beginning of the timing chamber exhaust stage of its cycle.

Referring now to FIG. 5 the timing exhaust stage of the operation is described. The diameter of exhaust orifice 72 is set to allow pressure to build up in valve piston passageway section 13D that connects with valve passageway 64. When the pressure is sufficient to overcome the frictional forces of O-rings 28, 32 and 53, and the opposing pressure remaining in timing passageway section 130, then valve piston 3 will move toward fluid entry passageway section 13A until it abuts shoulder wall section 73. In this position transverse port extension 56 is aligned opposite O-ring groove 27. This results in the contents in timing passageway section 13C leaking between the wall sections 95 and 96 of valve piston 3 and lower body part 4, respectively, so as to be discharged through central exhaust port 29 via the transverse port extension 56.

Figure 6:
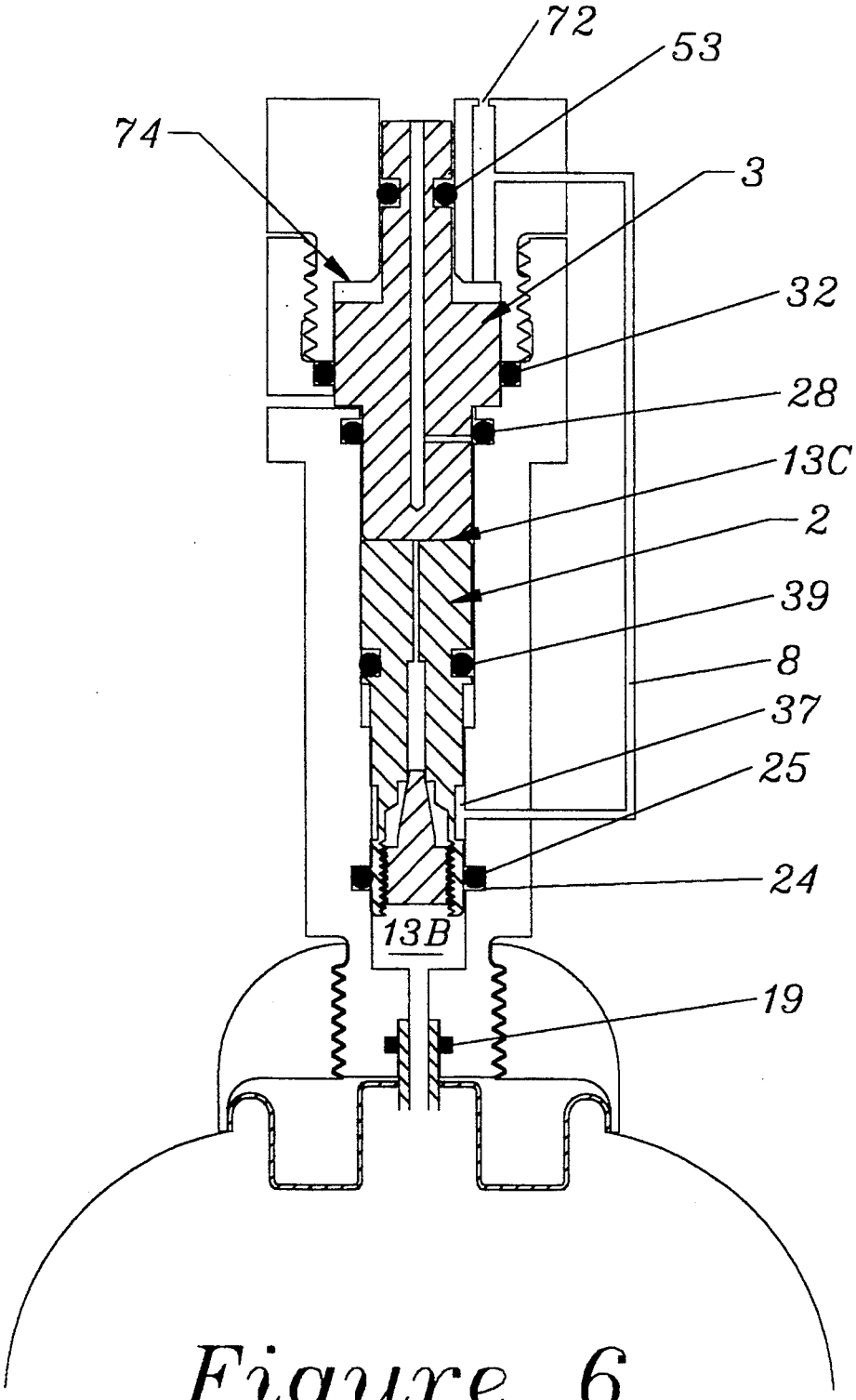
FIG. 6 is a cross-sectional view of the spray dispenser of the invention in the beginning of the resetting stage of its cycle.

The resetting stage of the operation is described with reference to FIG. 6. When the pressure in timing passageway section 13C has been sufficiently reduced timing piston 2 will now move toward valve piston 3 until it contacts valve piston 3. In this position annular groove 37 is no longer opposite O-ring 25. Thus, lower passageway section 13B is again sealed from exhaust passageway 8. The timing piston 2 continues to move and begins to push valve piston 3 until valve piston 3 abuts against shoulder wall section 74. When valve piston 3 abuts shoulder wall section 74, transport extension 56 extends above O-ring 28 permitting the operation cycle to begin again.

The sizing of the cross-sectional areas of the lower passageway section 13B, the timing passageway section 13C, the valve piston passageway section 13D and exhaust orifice 72 depend on a number of factors. Included in these factors are the pressure of container 100, the desired time between discharge, the nature the propellant and active ingredients. When these factors are known, proper sizing of the cross-sectional areas can be set.

In a preferred embodiment the following dimensions have proved satisfactory:

| | |
|---|---|
| Lower chamber cross-sectional area | 0.076 $in^2$ |
| Timing chamber cross-sectional area | 0.111 $in^2$ |
| Valve piston cross-sectional area | 0.243 $in^2$ |
| Orifice cross-sectional area | 0.00017 $in^2$ |

when dispersing a pesticide with a Fluorocarbon or a DME propellant from a pint container having an initial pressure between 30 and 90 psig, generally about 60 psig.

There are of course many obvious alternate embodiments which are intended to be included within the scope of this invention as defined by the claims below. One such alternate embodiment would include structuring the spray dispenser so that it could be fitted within the pressurized container 100 during the assembly of the container prior to the introduction of the pressurized fluid.

What is claimed is:

1. A spray dispenser operably attachable to a pressurized container containing liquid or gaseous material to permit timed discharges of discrete quantities of the material into the atmosphere, said dispenser comprises:

(a) an elongated body having a passageway with a central axis extending through and connecting opposite first and second ends of the elongated body; the passageway comprising a fluid entry passageway section, a lower passageway section, a timing passageway section, and a valve piston passageway section, the first end of the elongated body having the fluid entry passageway section shaped to receive the liquid or gaseous material from the pressurized container;

(b) a timing piston positioned in the passageway and shaped to slide within a portion of the passageway wherein a first end of the timing piston, along with the first end of the elongated body, form the lower passageway section within the passageway to receive the contents from the pressurized container;

(c) a valve piston having first and second ends positioned in the passageway, the first end of the valve piston, along with the second end of the timing piston, form the timing passageway section within the passageway, and the second end of the valve piston, along with the second end of the elongated body, form the valve piston passageway section within the passageway, and wherein the second end of the elongated body is provided with a valve passageway connecting the valve piston passageway to the atmosphere; and (d) an exhaust tube operatively connected at one end to the elongated body to receive the liquid or gaseous material from the lower passageway section when the lower passageway section is at approximately its minimum volume and operatively connected at an opposite end to the valve passageway formed in the elongated body which opens to the atmosphere, and wherein the lower passageway section and the timing passageway section are only connected to one another by a timing passageway to maintain a substantially constant pressure drop between the timing passageway section and the lower passageway section during operation of the spray dispenser; wherein the cross-sectional area of the passageway increases from the lower passageway section to the timing passageway section, and then to the valve piston passageway section; and wherein the cross-sectional areas of the passageway sections and the cross-sectional area of the valve passageway are sized to cause the timing piston to move along the central axis of the passageway in a manner to periodically operatively connect the lower passageway section to the exhaust tube permitting the contents to pass through the exhaust tube and into the valve passageway leading to the atmosphere.

2. A spray dispenser according to claim 1 wherein the elongated body comprises a lower part and an upper part which are sealingly connectable.

3. A spray dispenser according to claim 1 wherein the timing piston comprises:

(a) a piston body through which the timing passageway passes and (b) a needle valve affixable within the timing passageway to partially block the timing passageway.

4. A spray dispenser according to claim 1 wherein the valve piston comprises:

(a) a first section comprising the first end of the valve piston and having a cross-sectional area to permit it to slide within the passageway to vary the volume of the timing passageway section, (b) a second section extending from the first section, the second section having an upper end wall that forms part of the valve piston passageway section and a side wall that is slidable within the passageway while maintaining a fluid seal between the timing passageway section and valve piston passageway section, and (c) a third section extending from the second section, the third section having a side wall that is slidable within the passageway while maintaining a fluid seal between the valve piston passageway section and the passageway opening to the atmosphere.

5. A spray dispenser operably attachable to a pressurized container of liquid or gaseous material to permit timed discharges of discrete quantities of the material into the atmosphere which comprises:

(a) an elongated body through which extends a passageway whose central axis connects opposite first and second ends of the elongated body, wherein the passageway comprises a fluid entry passageway section positioned to receive the material from the pressurized container, a lower passageway section extending from the fluid entry passageway section, a timing passageway section, and a piston valve passageway section, all operably connected to permit timed discharge of the material into the atmosphere through a valve passageway formed in the elongated body having one end openable to the piston valve passageway section, its opposite end openable to the atmosphere, and another opening operably connected to the lower passageway section to receive the material therefrom;

(b) a timing piston positionable in the passageway and shaped to slide within a portion of the passageway comprising:

(i) a piston body having a timing passageway extending there through, the piston body having a first end and second end, wherein the first end, along with the first end of the elongated body, form the lower passageway section, and (ii) a needle valve attachable within one end of the timing passageway and sized to partially block the flow of any of the material through the timing passageway;

(c) a valve piston positionable in the passageway and shaped to slide within a portion of the passageway comprising:

(i) a first section having a first end, which along with the second end of the piston body, form the timing passageway section, (ii) a second section extending from the first section, and having an upper end wall that forms part of the valve piston passageway section, and having a side wall that is slidable within the passageway while maintaining a fluid seal between the timing passageway section and the valve piston passageway section, and (iii) a third section extending from the second section, and having a side wall that is slidable within the passageway while maintaining a fluid seal between the valve piston passageway section and the passageway opening to the atmosphere.

* * * * *